United States Patent [19]

Davis et al.

[11] 4,445,550

[45] May 1, 1984

[54] FLEXIBLE WALLED CONTAINER HAVING MEMBRANE FITMENT FOR USE WITH ASEPTIC FILLING APPARATUS

[75] Inventors: John C. Davis, Palatine; Ronald J. Reiss, Hoffman Estates, both of Ill.; Albert F. Rica, Stockton, Calif.

[73] Assignees: FranRica Mfg. Inc., Stockton, Calif.; Container Technologies, Inc., Barrington, Ill.

[21] Appl. No.: 409,903

[22] Filed: Aug. 20, 1982

[51] Int. Cl.[3] ..... B65D 41/50

[52] U.S. Cl. ..... 141/329; 53/469; 141/330; 206/525; 206/524.2; 220/410; 220/465; 222/105; 222/107; 428/35

[58] Field of Search ..... 206/525, 524.1; 220/410, 465, 461; 137/68 R; 141/329, 330, 10, 14, 313, 319, 339, 325, 326, 327; 222/107, 105; 428/35; 53/37

[56] References Cited

U.S. PATENT DOCUMENTS

| | | | |
|---|---|---|---|
| 2,930,170 | 3/1960 | Holsman et al. | 53/37 |
| 3,087,491 | 4/1963 | Gewecke et al. | 206/438 |
| 3,108,732 | 10/1963 | Curie et al. | 220/465 |
| 3,143,249 | 8/1964 | Merrill et al. | 220/410 |
| 3,190,441 | 6/1965 | Rausing | 206/525 |
| 3,340,671 | 9/1967 | Loo | 141/329 |
| 3,542,567 | 11/1970 | Finley et al. | 206/525 |
| 3,635,234 | 1/1972 | Dawson | 137/68 R |
| 3,653,546 | 4/1972 | Hazard | 222/83 |
| 3,836,425 | 9/1974 | Whiting, Jr. . | |
| 3,949,114 | 4/1976 | Viola et al. | 428/337 |
| 4,022,258 | 5/1977 | Steidley | 141/330 |
| 4,076,147 | 2/1978 | Schmit | 222/105 |
| 4,137,930 | 2/1979 | Scholle | 137/68 R |
| 4,165,023 | 8/1979 | Schmit | 222/105 |
| 4,201,208 | 5/1980 | Cambio, Jr. | 128/214.2 |
| 4,254,169 | 3/1981 | Schroeder | 428/35 |
| 4,291,085 | 9/1981 | Ito et al. | 428/215 |
| 4,309,466 | 1/1982 | Stillman | 428/35 |
| 4,378,069 | 3/1983 | Franco | 222/107 |
| 4,405,667 | 9/1983 | Christensen et al. | 206/524.2 |
| 4,407,873 | 10/1983 | Christensen et al. | 206/524.2 |

*Primary Examiner*—William T. Dixson, Jr.

*Attorney, Agent, or Firm*—McCaleb, Lucas & Brugman

[57] ABSTRACT

There is disclosed an aseptic flexible walled container having a rigid fitment member cooperative with an aseptic filling apparatus and including a neck, outer flanges surrounding the neck, a frangible membrane and an outer end rim receptive of an hermetically sealed lid. The neck is formed with an internal chamferred seating shoulder for fluid-tight engagement with a fill tube. One outer flange cooperates with clamping jaws of the aseptic filling apparatus for detachably sealing the fitment to a sterilizing chamber and placing it in position for insertion of the filling tube which ruptures the membrane and permits the aseptic introduction of product to the container's interior. The other outer flange is secured to an opening in a wall of the flexible container. The joined fitment and container are presterilized prior to filling. Selected materials for the multi-ply container walls and the fitment permit the container to withstand gamma ray and other sterilization treatment, heat and pressure while maintaining required strength. After the container is aseptically filled, such as with flowable food product, the fill tube is withdrawn and a lid is hermetically sealed onto the rim of the fitment. A heat shield adjacent a container wall surrounds the fitment to protect the container from excessive heat generated by the associated filling apparatus during filling.

18 Claims, 19 Drawing Figures

35
108
41
82
81
90
91
88
90
84
85
37
45
43
42
39
54
83
53
38
62
40
107
80
6
6
76
63
57
70
77
78
74
75
55
101
94
100
98
96
95
93
102
92
97

62
5C
107
94
38
93
74
63
57
55
92
75
76
5C 107
68
68
28
26
18
38
25
22
24
55
70
21
19
106
57
67
63
20

38
64
62
63
66
65

104
103
53
101
105
102
72
73
70
71
68
67
73
57
95
104
72
62
63

136
137
135
141
140
142
44
144
145
133
37
134
141

157
155
156
154
158
47
163
164
168
167
165
166
168
152
148
151
37
150
153

126
120
119
128
129
130
127
131
35

125
126
123
121
117A
118
117
113
114
110
41
115
120
112
36
111
116
132
108
119
127
37
42
65
131
39
40
38

FLEXIBLE WALLED CONTAINER HAVING MEMBRANE FITMENT FOR USE WITH ASEPTIC FILLING APPARATUS

BACKGROUND OF THE INVENTION

The present invention relates to packaging and is more particularly directed to multi-ply aseptic flexible containers with membrane fitment receptive of product from an aseptic filling apparatus of the type disclosed in the application for U.S. Letters Patent, filed Aug. 20, 1982 under U.S. Pat. Ser. No. 409,927, entitled "Method and Apparatus for Asceptically Filling Containers".

In recent years there has been an increased use of flexible containers as an alternative to large metal cans for packaging food products, such as juices, sauces, purees, fruits and vegetables, for institutional and commercial use. These flexible containers are often formed with walls intended to provide substantial oxygen permeation resistance. It has also been proposed to provide such containers with fitments through which food product can be introduced into the container and which can subsequently be closed to protect the container's contents. Prior art packages and filling apparatus for this purpose are shown in Ashton et al. U.S. Pat. No. 3,514,919, Holsman et al. U.S. Pat. No. 2,930,170, Lov U.S. Pat. No. 3,340,671, Barnby U.S. Pat. No. 3,356,510, Scholle U.S. Pat. No. 4,137,930, and Cambio U.S. Pat. No. 4,201,208.

In handling food products, it is extremely important that the flexible container be in sterile condition, that the filling take place under completely sterile conditions, that the flexible container's fitment cooperate with the container and filling apparatus to assure such aseptic filling conditions, and that the container remain sterile from the time it has been filled to the time its contents are removed. The present day commercial aseptic filling systems and flexible containers and fitments for use therewith do not adequately meet these desiderata.

OBJECTS OF THE INVENTION

Accordingly, it is an object of the present invention to provide a flexible walled bag or other container which has been presterilized and which includes a fitment including a rigid neck and a frangible membrane which extends across the neck and seals the interior of the sterilized container, all for use with an aseptic filling apparatus.

It is a further object of the present invention to provide a container as aforesaid having a rigid fitment capable of being retained in sealed communication with an opening in a sterilized filling chamber of a cooperating aseptic filling apparatus and sealed by a sterilized lid heat sealed to a rim portion of the fitment.

It is a further object of the present invention to provide a flexible walled aseptic container in which a fitment thereof carries a removable lid when it is locked into an opening in a sterilized filling chamber; the lid being removed by a lid handling mechanism within the filling chamber, shifted to a remote position within the chamber during filling and subsequently sealed over the open end of the fitment.

It is a further object of the present invention to provide a flexible walled container having a rigid fitment cooperative with a filling chamber wherein the exposed portion of the fitment, including a frangible diaphragm thereof, a lid and a lid handling and sealing means are sealed within the filling chamber such that the same can be sterilized by means of a sterilizing medium, such as steam prior to the filling operation.

It is a further object of the present invention to provide a presterilized flexible container for use with an aseptic filling apparatus in which a fill tube is utilized to introduce product into the container through a fitment on the container, the fitment having means capable of forming a fluid-tight seal with the fill tube below and inside the top rim of the fitment to prevent any product from being brought into contact with a sealing rim portion thereof.

It is a still further object of this invention to provide an aseptic liquid product storage container comprising flexible walls formed of selected materials having a high resistance to oxygen permeation to promote long shelf life of the product stored therein, as well as of materials capable of withstanding gamma ray sterilization.

Another important object of this invention is to provide a flexible walled container having a rigid fitment connectable to an aseptic filling means, the fitment being formed of materials selected to withstand gamma radiation sterilization, live steam temperatures, and substantial mechanical forces.

It is yet another object of this invention to provide a presterilized flexible container and rigid fitment for use with an aseptic filling means which container has a heat shield surrounding said fitment operable to protect the container from excessive heat generated during the filling operation.

SUMMARY OF THE INVENTION

In order to achieve the above and various other objects, the present invention contemplates a flexible walled bag or container of the type having a rigid fitment, a heat shield adjacent a bag wall and surrounding the fitment, the fitment including a rigid neck, a frangible membrane sealing said neck, a rim for sealably receiving a lid, outwardly extending flanges spaced from said rim, and sealing means for effecting fluid-tight engagement with a fill tube of a filling apparatus, the latter comprising an enclosed filling chamber with an upper wall and a platen forming its lower wall and provided with an opening for detachably and sealably receiving the container fitment. Clamping means are provided adjacent the platen opening for surrounding the fitment neck and forcing the fitment flange against the platen so that the fitment effectively seals off the platen opening during the filling operation.

The preferred container of the present invention is a multi-ply flexible bag including a fitment, both of which have been presterilized prior to product filling, such as by gamma radiation. Most copolymer materials used in forming the prior art flexible containers and fitments that were subjected to such radiation sterilization techniques became embrittled with resultant decreased strength characteristics. Fitment flanges tended to shear off under excessive mechanical forces. Further, the walls of filled containers also tended to crack during shipment or would become weakened during filling with heated food product.

While the cooperating aseptic filling apparatus for use with the present flexible container and membrane fitment is more fully summarized in the above-noted copending application, Ser. No. 409,927, the apparatus' filling chamber encloses a vacuum lid handling means and heat sealing unit effective initially to remove a thin foil lid which is temporarily carried on the upper rim of the fitment. The lid is transferred to a position within the filling chamber remote from the fitment and is ultimately replaced after sterilization on the fitment after the bag is filled. The lid is then heat sealed to the rim.

The filling chamber further includes an inlet through which steam or other sterilizing medium can be introduced to sterilize the exposed portions of the fitment including its flexible membrane, the lid and the lid handling mechanism. Further to the above, the fitment is formed of a suitable material to withstand such sterilization.

The filling chamber also carries a filling means which includes a fill tube. After the present fitment has been locked in place and the filling chamber sterilized, the fill tube is projected downwardly into engagement with the interior of the fitment neck, accomplishing two things. First, the fill tube carries a member which ruptures the frangible membrane of the fitment to provide access to the interior of the presterilized present flexible container and, secondly, a bevelled shoulder on the inside of the fitment's neck sealingly cooperates with the fill tube to keep any food product from contacting the fitment's uppermost rim during the filling operation.

One of the advantages of the present fitment then is that it insures the presterilized flexible bag will remain sterilized until it is filled with food product by the associated aseptic filling apparatus. Specifically, prior to filling, the bag is positively sealed by the fitment's membrane which is integral with the fitment. This membrane and all exposed portions of the fitment are sterilized as by steam prior to the time the diaphragm is ruptured and the bag is filled.

Another advantage of the presterilized flexible container and membrane fitment of the present invention is that the filling apparatus is maintained in, and product filling occurs under, an aseptic condition while connected to the fitment. That is, the membrane fitment, even though presterilized by gamma radiation which normally induces embrittlement in such relatively rigid plastic objects, is of such material that it retains its strength such that it is capable of being forcibly and sealably engaged against the filling apparatus' platen. Thus, since the apparatus' enclosed filling chamber and the exposed areas of the membrane fitment are sterilized after the bag fitment has been locked in place at the commencement of each filling cycle, and further, since the fill tube is normally stored within its own sealed housing and is projected into the filling chamber only after that chamber has been sterilized at the commencement of a cycle, the fill tube is never exposed to an unsterile environment.

Yet another advantage of the present container and fitment is that the fitment's separate lid is assured of being completely and effectively sealed to the rim of the fitment since the uppermost rim is kept free of any food particles which would lead to a defective seal by virtue of the sealing engagement of the fill tube and fitment neck during the filling operation.

BRIEF DESCRIPTION OF THE DRAWINGS

These and other objects and advantages of the present invention will be more readily apparent from a consideration of the following detailed description of the drawings and a preferred embodiment of the invention.

In the drawings:

FIG. 3 is a cross-sectional view taken along line 3—3 of FIG. 1.

DESCRIPTION OF A PREFERRED EMBODIMENT

Figure 13:
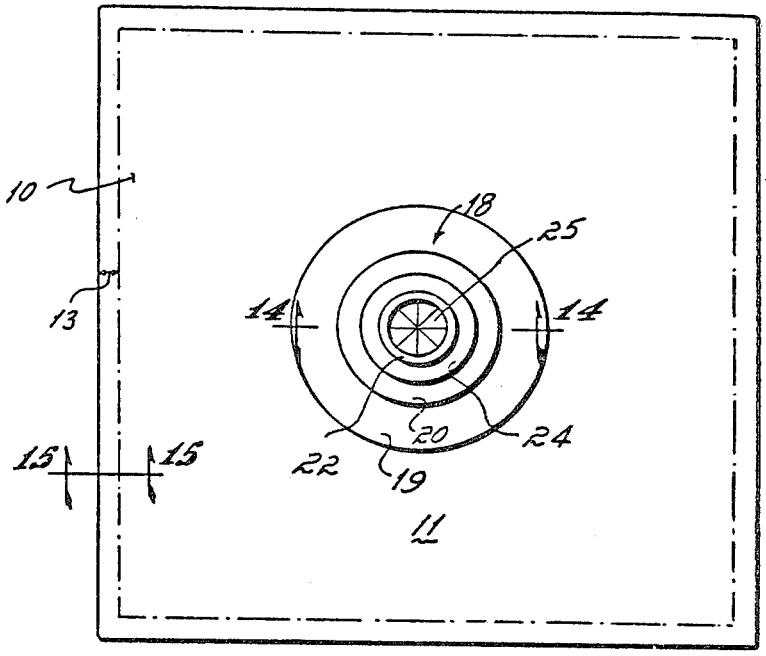
FIG. 13 is a plan view of one preferred form of flexible container.
Figure 14:
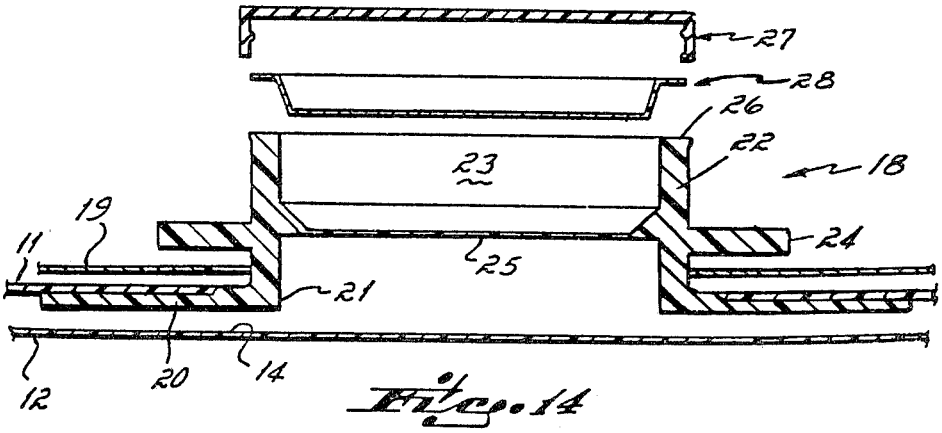
FIG. 14 is a cross-sectional view along line 14—14 of FIG. 13.
Figure 15:
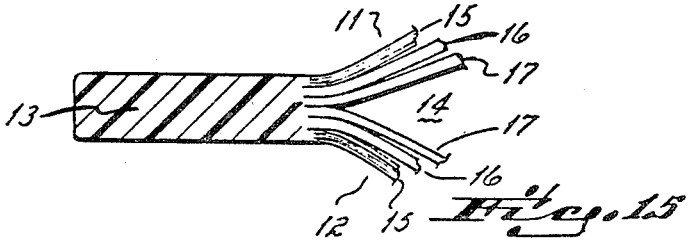
FIG. 15 is an enlarged semi-diagrammatic cross-sectional view along line 15—15 of FIG. 13.

A preferred form of container 10 for use in conjunction with the aseptic filling apparatus is illustrated in FIGS. 13, 14 and 15. As there shown, the container 10 is formed as a flexible walled bag of generally rectangular plan configuration. The container comprises superposed upper and lower multi-ply flexible walls 11 and 12 which are sealed together about the periphery thereof by heat seals 13 (see FIG. 13). The space 14 between upper wall 11 and lower wall 12 is adapted to contain flowable sterilized food product, such as, for example, vegetable particulates, fruit concentrates, purees, sauces and juices.

In the preferred embodiment of the container, the composite upper and lower walls are identical with each wall comprising three separate plies. The outer ply 15 of each wall is a multilayer barrier film of seven layers in which the outer layer is formed of nylon film 0.0007" thick. One suitable grade of nylon is known as "Nylon 6". The next innermost layer is formed of ethyl vinyl alcohol and is 0.0003" in thickness. The third layer is a 0.0002" thick layer of nylon similar to the outer layer. The next innermost layer is a bonding tie layer 0.0002" in thickness. This tie layer is preferably a copolymer of linear low density polyethylene known as "Plexar-II" made by Chemplex Company of Rolling Meadows, Illinois, which material is more fully described in U.S. Pat. No. 4,254,169 at column 3. The next layer of ply 15 is formed of linear low density polyethylene (L.L.D.P.E.) 0.0007" in thickness. The next layer is another tie layer similar to that previously described, 0.0002" in thickness. The innermost layer of the outer ply 15 is a layer of linear low density polyethylene 0.0012" in thickness. The construction of this type barrier lamination, typically formed as a co-extrusion, is more fully disclosed in Schroeder U.S. Pat. No. 4,254,169.

The center ply 16 and the inner ply 17 of walls 11 and 12 are each formed of linear low density polyethylene 0.0035" in thickness. Plies 15, 16 and 17 while superposed are not interjoined except at seals 13, and are therefore free to move relative to one another. This feature promotes mechanical strength of the container walls affording high strength to withstand shipment and handling. Further, the materials are selected to provide high oxygen permeation resistance to provide a long shelf life.

In a modified alternate of the above described container wall structure, the seven layer outer ply 15 is made up of only five layers, namely a 60 gauge Nylon 6 outer layer; a second or tie layer of L.L.D.P.E. a third layer of metal foil, such as 0.0035" thick aluminum, a fourth or tie layer of L.L.D.P.E., and a fifth layer of L.L.D.P.E. substantially 0.002" thick. The second and third plies 16 and 17 of this modified wall structure are both 0.002" thick L.L.D.P.E. This wall structure has improved barrier capabilities particularly to light penetration in the ultraviolet range.

In a typical application, flexible bag 10 is sized to hold 300 gallons of material. It is to be expressly understood, however, that bags of other capacities such as, for example, five or 50 gallons, and bags formed of other wall materials, whether of the barrier type or not, can be utilized with the present fitment and disclosed filling equipment.

As shown in FIGS. 13 and 14, bag 10 is importantly provided with a rigid fitment 18 through which the product is introduced into the bag. Fitment 18 is preferably molded of a suitable material, such as high density polyethylene free of pin holes or cracks and capable of withstanding gamma ray radiation without significant embrittlement or loss of strength. These requirements are especially important due to the extreme clamping forces and temperatures placed on the fitment during the filling operation, as is described in more detail later herein. A high density polyethylene molding material known as ARCO PETROCHEMICAL RESIN No. 7050 has been found satisfactory for this purpose. The present fitment includes a lower, outwardly extending circular flange 20 which is adapted to be heat sealed to the inside of the inner layer 17 of one wall (such as wall 11) of the container. This flange surrounds a circular opening 21 cut into the bag wall.

Fitment 18 further includes an upstanding rigid cylindrical neck 22 forming a fill opening 23 of the order of 2" in diameter. In the preferred embodiment, the neck is approximately 1" in height. Neck 22 carries an intermediate external clamping flange 24 which is spaced from the lower flange 20 a sufficient distance, for example, 0.250", to accommodate clamping jaws of an aseptic filling machine as explained hereinafter. In a preferred embodiment of the container, the outer diameter of clamping flange 24 is less than the diameter of the lower flange, e.g., the diameter of the lower flange is 4.5", while the diameter of the intermediate flange 24 is 3.25". A radius is preferably formed at the junction of flange 20 and neck 22 to increase strength.

Fitment 18 further comprises a transverse frangible membrane, or diaphragm, 25 which extends across the fill opening 23 and seals the interior of the bag. Membrane 25 is sufficiently strong to withstand a pressure of from 15–30 psi to which the membrane is exposed during steam sterilization immediately prior to filling. In the preferred form of fitment, this membrane is molded integral with the fitment neck and is approximately 0.048" thick. The diaphragm is provided with a plurality of radial grooves which extend partially through the diaphragm to provide separable segments 25*a* (see FIG. 13). In the preferred embodiment, these grooves are approximately 0.015" in depth. Membrane 25 is spaced downwardly from the outer annular flat rim 26 on the top end of the neck, for example, by ¼". A bevelled shoulder 29 is formed at the juncture of membrane 25 and neck 22. The external surface of neck 22 is configurated to form a standard 63–400 "M" style thread. This thread is adapted to receive a standard 63 mm protective screw cap 27.

An alternate, two piece type of membrane (not shown) similar in appearance to membrane 25 comprises a separate polyethylene foil lamination disk. In that case, while the bevelled shoulder 29 would still be integrally formed with the fitment neck 22, the integral membrane 25 would be deleted. Instead, the alternate foil disk membrane would be heat sealed to the underside of the bevelled shoulder 29, prior to joinder of the fitment 18 to the container 10. In all other respects, the alternate foil disk membrane would operate as the preferred integral membrane 25.

In the preferred embodiment, bag 10 also carries a heat shield 19. This heat shield is of annular configuration and is formed as a laminate of aluminum foil and polyethylene, preferably a L.L.D.P.E., 3 mils thick. The heat shield has a central circular opening which is of smaller diameter than fitment flange 24. As a result, the heat shield 19 is stretched over flange 24 and placed in contact with the outer wall of bag 10. The heat shield thereafter remains in place covering the wall 11 of the bag adjacent to fitment 18. The function of heat shield 19 is to protect the bag, as well as the bag-to-fitment seal, from excessive heat buildup during steam sterilization of the filling equipment and fitment so that the interior plys of the bag do not tack together.

As explained in detail below, after filling, bag 10 is sealed by means of a circular disc, or lid, 28 which is placed over the neck 22 and is heat sealed to the outer rim end 26. Disc 28 is preferably formed of a multilayer material, including layers of Nylon, linear low density polyethylene (L.L.D.P.E.), and aluminum foil which are adhesively bonded together.

Figure 1:
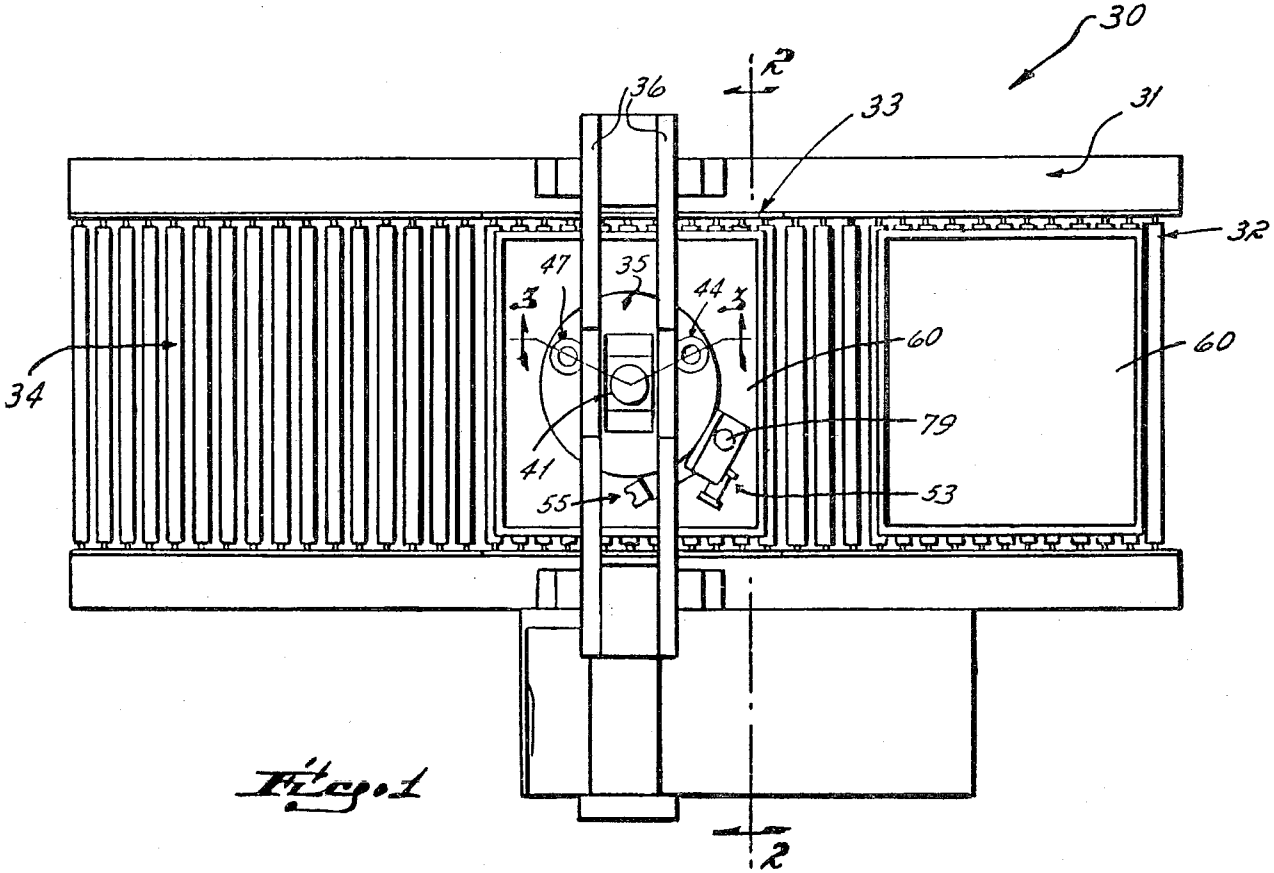
FIG. 1 is a top plan view of a filling machine for use with the present invention.
Figure 2:
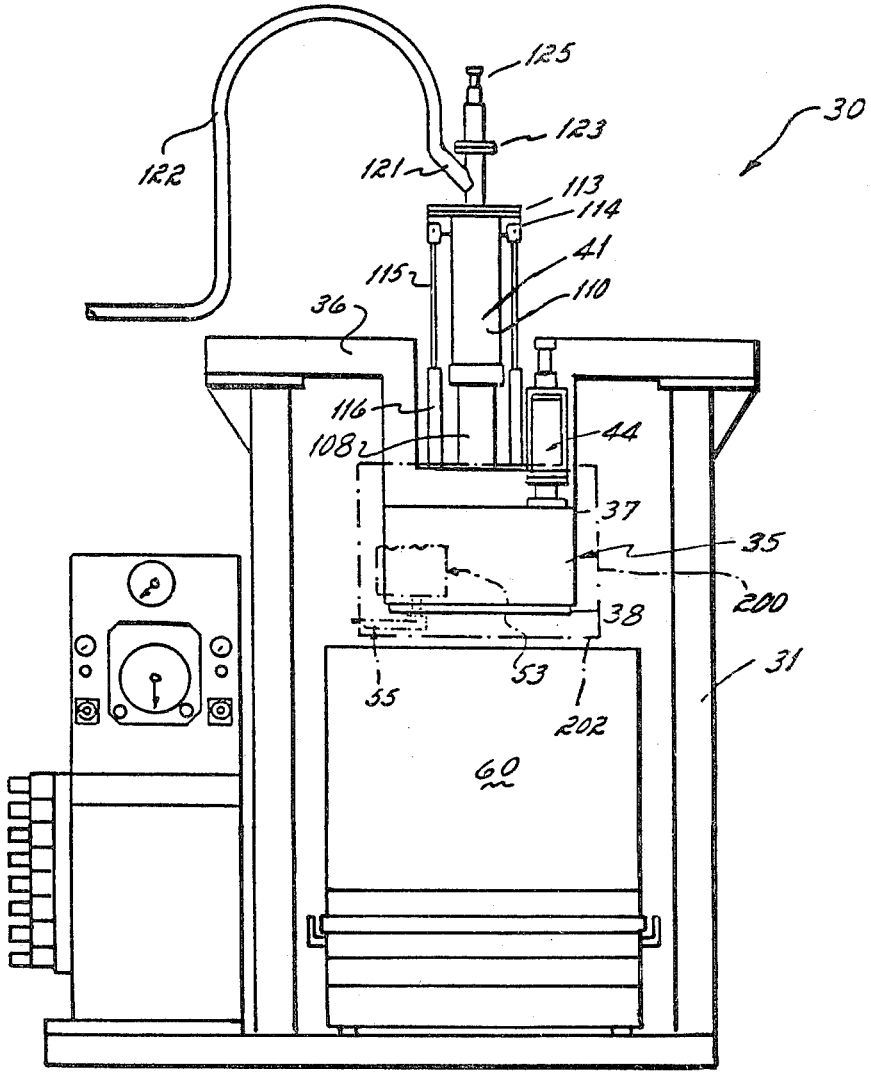
FIG. 2 is a cross-sectional view taken along line 2—2 of FIG. 1.
Figure 2:
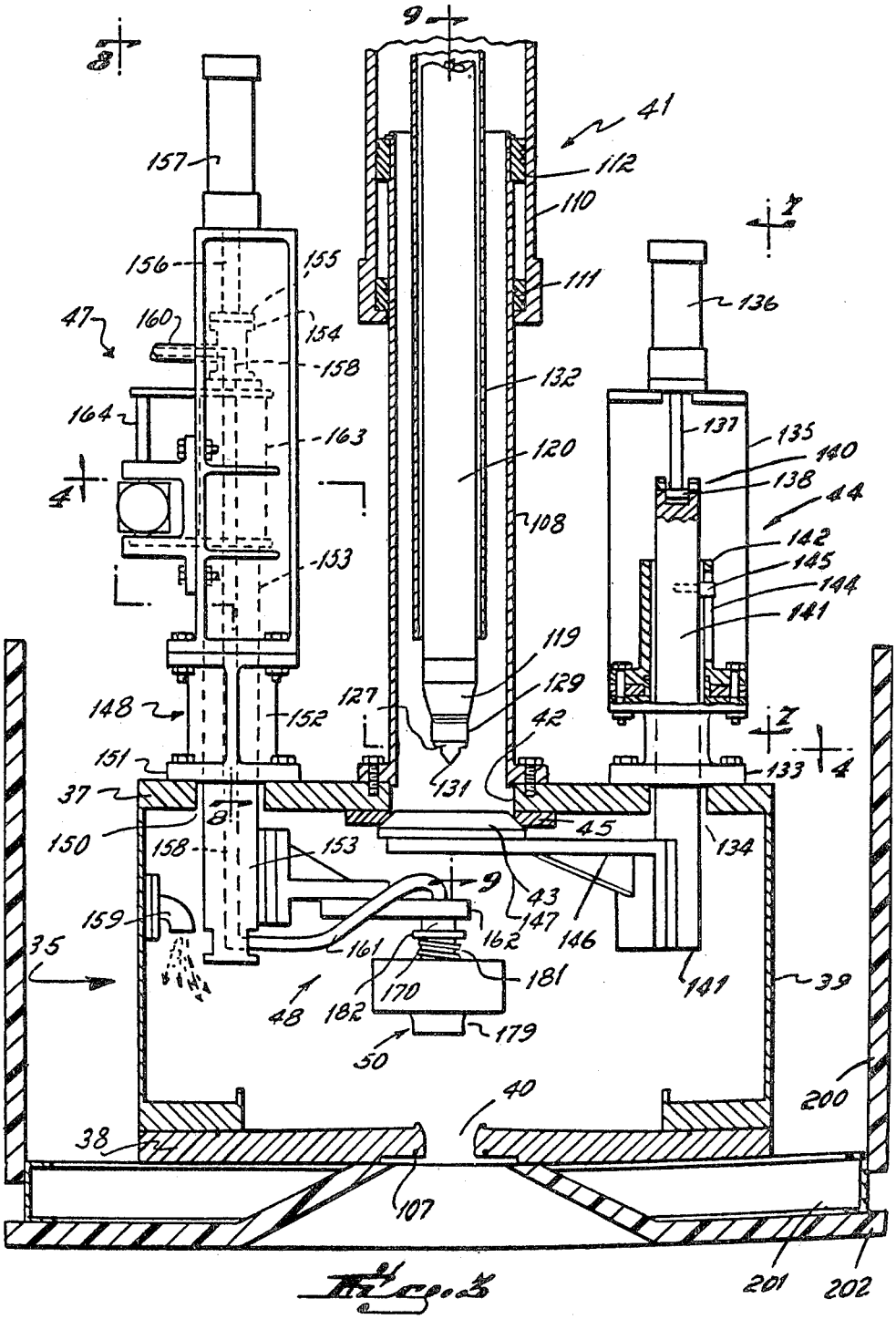

The overall construction of a filling machine 30 useful with the present invention is best shown in FIGS. 1–3. As there shown, the machine includes a frame 31 which supports an infeed roller conveyor section 32, a lift table 33 and a discharge roller conveyor section 34. Lift table 33 is positioned beneath a filling chamber 35 which is mounted upon horizontal supports 36 extending transversely across the lift table.

In the embodiment shown, filling chamber 35 is generally cylindrical and includes an upper wall 37 and a lower wall, or platen, 38 interconnected by a vertical peripheral wall 39. A filling tube assembly 41 is mounted above a circular opening 42 in the center of upper wall 37. As explained in detail below, clamping jaw means are provided for holding a bag 10 beneath the filling chamber 35. When the bag is so positioned, the bag fitment 18 is located in central opening 40 in platen 38. The fill tube assembly includes means for puncturing the frangible membrane 25 of a fitment held in opening 40 by the clamping jaws and means for introducing product into the bag. The fill tube assembly is adapted to be sealed off from the filling chamber by closing circular opening 42. This opening is closed by a closure member 43 carried by an actuator 44 which is in turn mounted upon upper wall 37. Actuator 44 is effective to pivot closure member 43 about the axis of the actuator and to raise it into a sealing position in which it engages an annular seat 45 surrounding opening 42. The actuator 44 is also effective to lower closure member 43 and to pivot it to a storage position in which it is spaced free from opening 42 as indicated by dotted lines 46 in FIG. 4.

Upper wall 37 of the sealing chamber also carries an actuator 47 for lid positioning and sealing mechanism 48. This mechanism includes a vacuum head 50 mounted within the filling chamber for lifting a lid 28 from a container to be filled and shifting the lid to a position remote from opening 40 in platen 38 (as indicated by dotted lines 52 in FIG. 4) where the lid is held, while the filling chamber, bag fitment and lid are sterilized. Actuator 47 is thereafter effective to pivot vacuum head 50 and the lid 28 which it is carrying to a position over opening 40. The actuator next lowers head 50 and lid 28 so that the lid is brought into contact with the upper rim 26 of the fitment of the filled bag and heat sealed to the rim.

A fitment clamp jaw actuator 53 is mounted adjacent to the peripheral wall 39 of the filling chamber. This actuator can be supported in any suitable manner, for example, by means of a bracket arm 54 (FIG. 5). Clamp jaw actuator 53 carries a first clamp jaw 55 which can be reciprocated toward and away from the center of opening 40 and can be pivoted to a position remote from the opening as indicated by dotted line 56 in FIG. 4. As is explained in detail below, clamp jaw 55 is adapted to cooperate with a secondary reciprocating clamp jaw 57 to engage the undersurface of intermediate flange 24 of the bag fitment 18 to forcibly hold the fitment in position within opening 40 and in sealed engagement with the platen 38.

While being filled, bag 10 is supported on the lift table within a shipping box 60. Box 60 is constructed of any suitable material, such as plywood and is of generally square outline configuration with an open top. It is desirable to line the box 60 with a smooth slick material, such as fiberboard, so no rough edges can damage the bag, and so the bag is free to slip and move as it fills. The bag is oriented within the box with fitment 18 uppermost.

Boxes 60 are fed to a position on the lift table from the inlet conveyor 32. Once on the lift table the boxes are positioned directly beneath the filling chamber 35 and are adapted to be raised or lowered by raising or lowering the lift table using any suitable means, such as a hydraulic cylinder and piston illustrated diagrammatically at 61 in FIG. 11.

Figure 4:
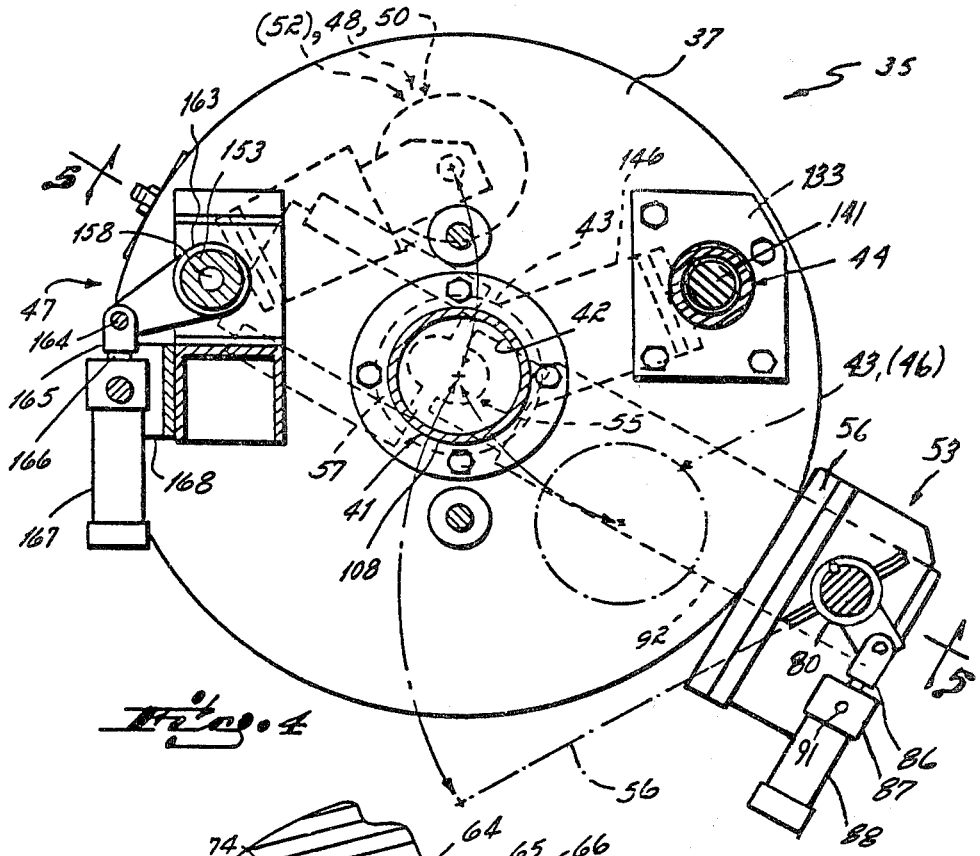
FIG. 4 is a cross-sectional view taken along line 4—4 of FIG. 3.
Figure 6:
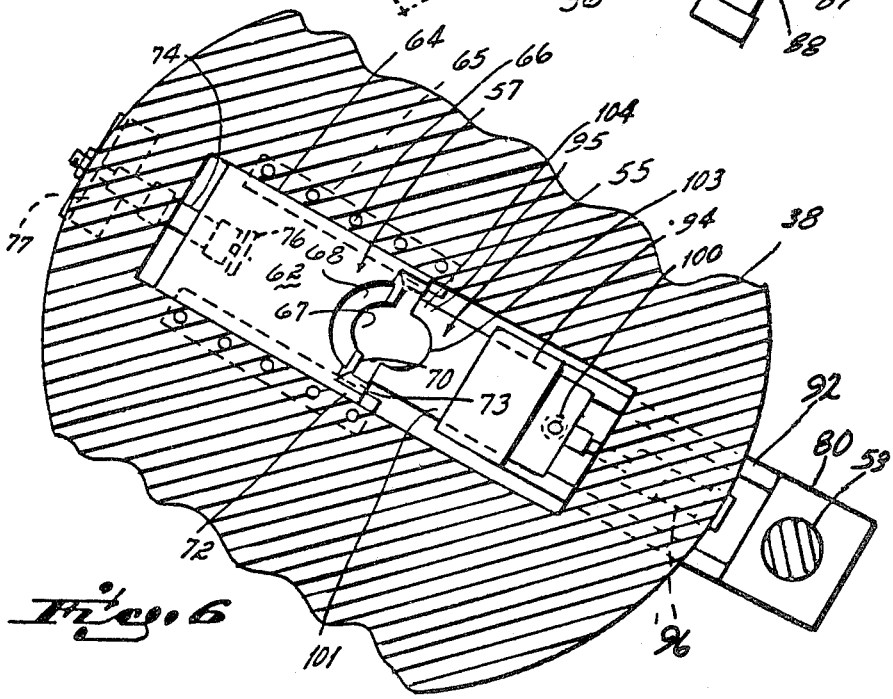
FIG. 6 is a cross-sectional view taken along line 6—6 of FIG. 5.
Figures 5, 5A, 5B, 5C, 5D:
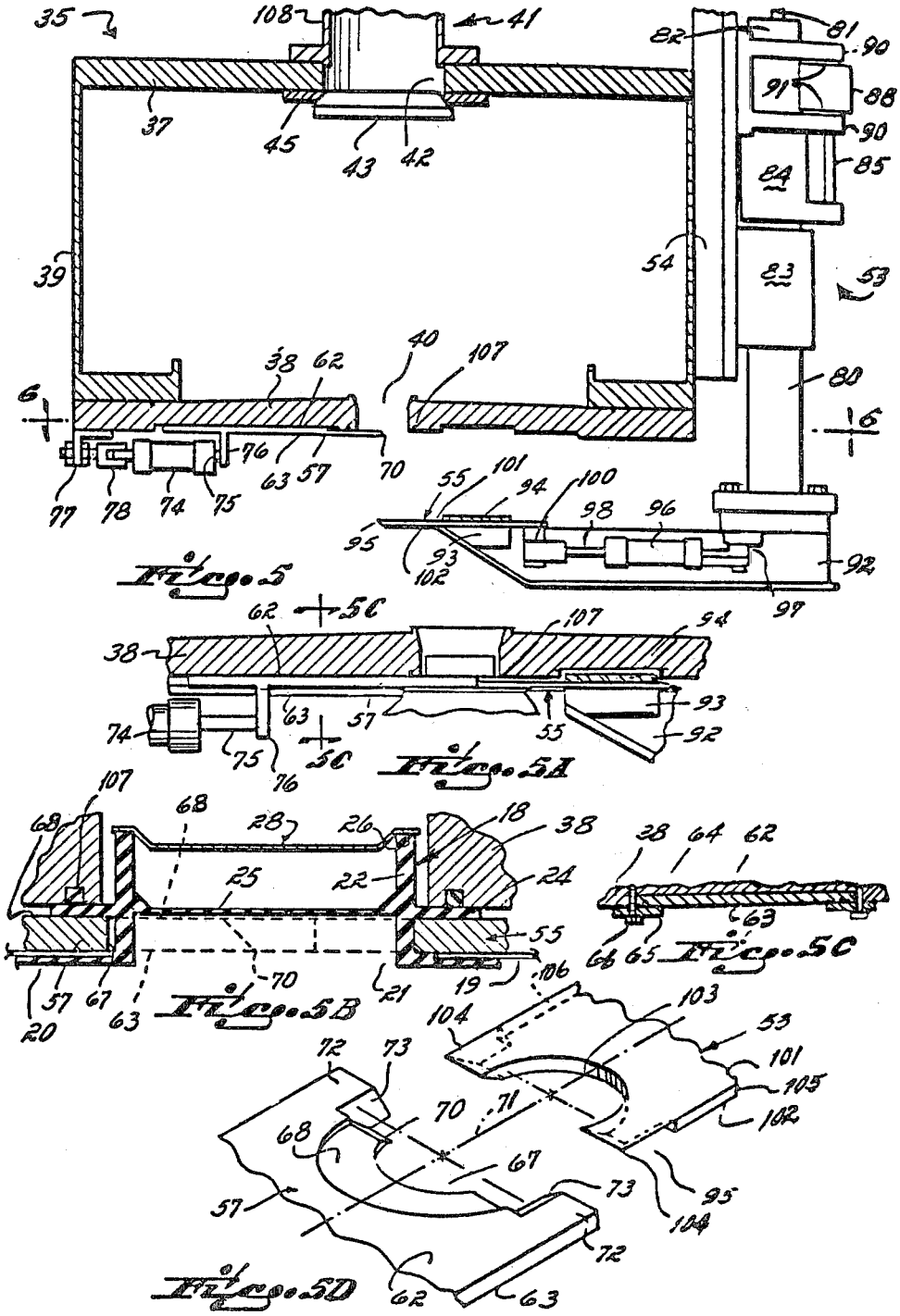
FIG. 5 is a cross-sectional view taken along line 5—5 of FIG. 4.
FIG. 5A is an enlarged cross-sectional view through the platen and clamping jaws similar to FIG. 5 except that in FIG. 5A both jaws are shown clamped around a bag fitment of the present invention.
FIG. 5B is an enlarged, vertical, cross-sectional view through the platen opening showing the manner in which a bag fitment is clamped in position.
FIG. 5C is a cross-sectional view taken along line 5C—5C of FIG. 5A.
FIG. 5D is a partial perspective view of the fitment-engaging clamp jaws.

The details of the bag clamping mechanism are best shown in FIGS. 4–6. As there shown, the clamping mechanism comprises a reciprocating clamping jaw 57 mounted beneath platen 38. Jaw 57 has a flat upper face 62 and a flat lower face 63. The jaw reciprocates in a groove 64 machined into the undersurface of the platen and is guided by two restraining strips, or gibs, 65 which are bolted to the platen as by means of bolts 66. These strips prevent vertical movement of the jaw. The inner portion of jaw 57, i.e., the portion adjacent opening 40, has a semicircular cut-out portion 67 surrounded by a flange 68.

The thickness of flange 68 is approximately 0.235", which distance is slightly less than the 0.250" spacing between the intermediate flange 24 and lower flange 20 of bag fitment 18. The leading edges 70 of annular flange 68 are tapered downwardly and outwardly at 45° from upper face 62 of the jaw in the direction of the axis 71 of the jaw.

Jaw 57 further comprises two extensions 72 which project parallel to axis 71 outwardly beyond cut-out 67. These extensions include transversely tapering walls 73 which taper inwardly and downwardly at 45° from upper face 62 toward axis 71. Jaw 57 is adapted to be advanced to a position in which it extends approximately half way across opening 40 as illustrated in FIGS. 5A and 5B and to be retracted to a position in which it is withdrawn from interference with opening 40, and from interference with the intermediate fitment flange 24.

The position of jaw 57 is controlled by means of a hydraulic cylinder 74 having a piston 75 connected to a depending flange 76 carried by jaw 57. Cylinder 74 is mounted upon an angle bracket 77 secured to platen 38 in any suitable manner, such as by means of coupling 78.

The pivotal jaw 55 is carried by actuator 53. More particularly, as shown in FIG. 5, actuator 53 includes a vertical shaft 80 which is adapted to be shifted up and down by means of a hydraulic cylinder 79 (FIG. 1) enclosing a piston connected to rod 81. Rod 81 is joined to shaft 80 through a thrust bearing 82 which is effective to transmit force in a vertical direction from piston rod 81 to shaft 80, while permitting rotation of shaft 80 relative to the piston rod. Shaft 80 is journalled in a journal 83 carried by support arm 54. A sleeve member 84 surrounds shaft 80 and is rigidly secured thereto for both rotational and reciprocating movement therewith. Sleeve member 84 carries a parallel spaced vertical rod 85 which is slidably engaged by a bracket 86 mounted on piston rod 87 associated with hydraulic cylinder 88 (FIG. 4).

Cylinder 88 is carried between mounting arms 90 which are in turn secured to mounting plate 54. Cylinder 88 is pivotally mounted to arms 90 by means of two vertical pivot pins 91 which extend above and below the cylinder and are received in suitable bearings carried by the arms 90. Thus, hydraulic cylinder 88 is effective to advance and retract piston rod 87, and through its connection with shaft 85, to cause rotation of shaft 80 about its vertical axis.

A horizontal cantilever arm 92 is mounted in any suitable manner upon the lower end of shaft 80. This cantilever arm carries at its outer arm clamping jaw 55. Clamping jaw 55 is mounted for reciprocating movement along the axis of cantilever arm 92. The clamping jaw 55 is supported by a lower block 93 and is guided by means of a channel-shaped guide block 94 having an opening of rectangular configuration extending along the axis of cantilever arm 92. Guide block 94 is effective to constrain clamping jaw 55 to reciprocating axial movement along arm 92 while permitting very limited upward tilting movement of the free end 95 of clamping jaw 55. The jaw is moved in and out by means of a hydraulic cylinder 96 which is rigidly connected to the lower end of shaft 80 and cantilever arm 92 as at 97. This cylinder includes piston rod 98 which is connected to jaw member 55 through a pivot rod 100.

As shown in FIGS. 5B and 5D, jaw 55 is of generally rectangular cross-section having a flat upper face 101 and a flat lower face 102. The portion of the jaw adjacent to opening 40 in platen 38 is provided with a circular removed portion 103 and axial extensions 104 disposed in either side of the removed section. These extensions are provided with a downwardly and rearwardly bevelled surface extending from the free end of the jaw. The bevel is at an angle of 45° to match the bevel along edge 70 of jaw 57. The forward portions of the side edges 105 and 106 are also bevelled downwardly and inwardly at an angle of 45° to mate with surfaces 73 of jaw 57. The axial extensions 104 of the jaw 55 extend beyond the center of the circular removed portion 103 so the opening is reduced to less than the diameter of the fitment neck 22, thus necessitating that the fitment be "snapped" into place.

In order to support a present bag for filling, the fitment 18 of a bag is inserted in semicircular opening 103 of jaw 55 in such a manner that the jaw member surrounds the neck portion 22 between the intermediate flange 24 and lower flange 20. The cantilever arm 92 is then rotated and jaw 55 advanced by means of cylinder 96 until the fitment 18 is in alignment with opening 40 in platen 38. Then the vertical cylinder 79 acting through piston rod 81 raises shaft 80, cantilever arm 92 and jaw 55 to insert the fitment 18 into opening 40 as shown in FIG. 5B. Secondary jaw 57 is then shifted from a position spaced from opening 40 into the position shown in FIG. 5B in which it embraces neck 22 of the fitment between intermediate flange 24 and bottom flange 20.

As secondary jaw 57 is advanced, its bevelled surfaces 70 and 73 engage the cooperative surfaces on clamping jaw 55 forcing that jaw upwardly to forcibly engage and clamp intermediate flange 24 against the bottom surface of platen 38. In the preferred embodiment, the clamping force generated by these bevelled surfaces is substantial, i.e. on the order of 600 pounds. The engagement under this appreciable clamping force of intermediate flange 24 with the bottom surface of platen 38 and the compression of a sealing ring 107 mounted in the bottom wall of the platen forms a fluid-tight seal between the platen and the exterior of fitment 18. Because of the compressive forces involved, selection of the material for fitment 18 is crucial in view of the embrittlement problem encountered with gamma radiation sterilization.

In filling such large bags as the 300 gallon unit, it is important to prevent the bag from folding on itself while filling, as this would reduce the available volume of the bag. It is also necessary to protect the bag from the hot surfaces of the fill chamber. For these purposes, the fill chamber is surrounded by a plastic-sided box 200. The side walls of this box are outfitted with spring-loaded clamps (not shown) which are used to hold the bag tightly to the plastic enclosure after the fitment has been placed into the fill chamber opening 40, while the shipping box 60 is raised around the fill chamber.

More particularly, as shown in FIG. 3, box 200 comprises four upstanding planar walls formed of a suitable plastic material. These walls are secured to a suitable frame 201 in any suitable manner. Frame 201 preferably is formed of channel members and is mounted upon the lower surface of platen 38 as by means of suitable bolts. Frame 201 also carries a plastic sub-platen 202 formed of Lexan, or the like, which insulates bags 10 from the metal platen 38. It is to be understood that both frame 201 and sub-platen 202 are provided with an elongated removed section extending from their periphery to an opening aligned with opening 40 to permit in an out movement of clamping jaw 57. It is also to be understood that frame 201, sub-platen 202 and box 200 have been omitted from FIGS. 5, 9, and 12, and have been shown in phantom in FIG. 2 for purposes of clarity.

As filling of the bag proceeds, the weight of the product easily pulls the bag from the spring clips. To prevent the bag from folding on itself during filling, it is necessary to completely fill that portion of the bag which extends into the annular space between the shipping box 60 and the plastic enclosure. Side pressure of the product in the bag against the annular walls supports the bag. As a further aid, the bottom plastic platen 202 extends beyond the channel frame 201 for the plastic enclosure, thus forming a lip which helps prevent the bag from dropping excessively as the shipping box is lowered.

The details of construction of fill tube assembly 41 are best shown in FIGS. 2, 3, 5 and 9. As there shown, the fill tube assembly includes an upstanding guide tube 108 which is bolted or otherwise secured and sealed to the upper wall member of the filling chamber surrounding an opening 42. A movable outer tube 110 surrounds guide tube 108. Tube 110 carries at its lower end a packing ring assembly 111 of any suitable construction for forming a fluid-tight seal between outer tube 110 and guide tube 108. Guide tube 108 similarly carries at its upper end a packing ring assembly 112 for providing a second fluid-tight seal between tubes 108 and 110. Tube 110 is secured and sealed at its upper end to a platen 113. This plate is in turn connected through coupling members 114 to piston rods 115 associated with the hydraulic cylinders 116.

More particularly, each of the coupling members 114 includes an upstanding stud 117 which passes upwardly through a bearing sleeve fitted in a bore in plate 113. A compression spring 118 surrounds each of the studs 117 and is compressed between plate 113 and lock nuts 117A. The compression springs serve to control the downward force of the fill tube when it seats against the fitment. Cylinders 116 are preferably rigidly mounted to the upper wall 37 of the filling chamber and provide means for raising and lowering tube 110 and the various components which it carries. Plate 113 is provided with a central opening which receives a vertical fill tube 120. The juncture between fill tube 120 and plate 113 and tubes 108 and 110 form a housing for the portion of fill tube 120 below plate 113. Fill tube 120 is preferably of circular cross-section. At its lower end it includes an inwardly tapered portion 119 and a lowermost tubular section 129 of reduced diameter. Fill tube 120 extends upwardly above plate 113 and is joined with a tube 121 adapted to be interconnected to flexible feed tube 122 through which product is pumped into fill tube 120.

The upper end of fill tube 120 also carries a flange 123 above which is mounted a hydraulic cylinder 125 having a piston rod connected to fill valve actuating rod 126. Actuating rod 126 extends downwardly through the fill tube to a pear-shaped valve member 127. This member is adapted to be raised so that its upper frustoconical surface 128 seals against a cooperating seat 130 formed at the lower end of the fill tube. The lower portion of valve 128 tapers downwardly to form nose 131.

An intermediate tube 132 surrounds fill tube 120 in spaced relation thereto. Intermediate tube 132 is secured at its upper end to plate 113 and extends downwardly in concentrically spaced relationship to fill tube 120. The lower end of intermediate tube 132 is spaced from the bottom of the fill tube so that when the fill tube is in this lowermost position, intermediate tube 132 remains spaced above platen 38.

Figures 7, 8, 9, 10:
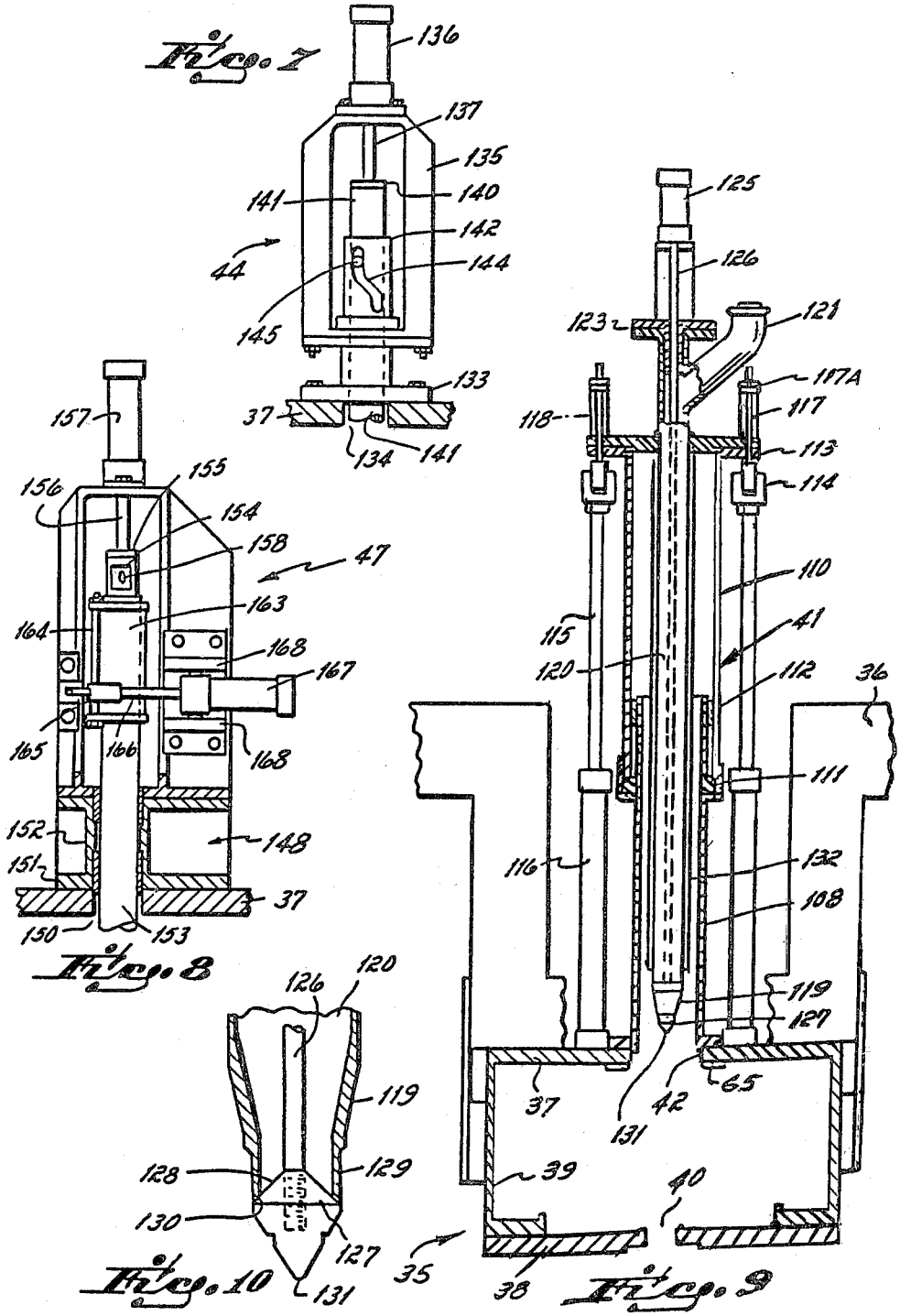
FIG. 7 is an elevational view of the filling tube closure member actuator taken along line 7—7 of FIG. 3.
FIG. 8 is a view partially in section of the vacuum head actuator taken along line 8—8 of FIG. 3.
FIG. 9 is a cross-sectional view taken along line 9—9 of FIG. 3.
FIG. 10 is an enlarged sectional view of the lower end of the fill tube and valve.
Figure 11:
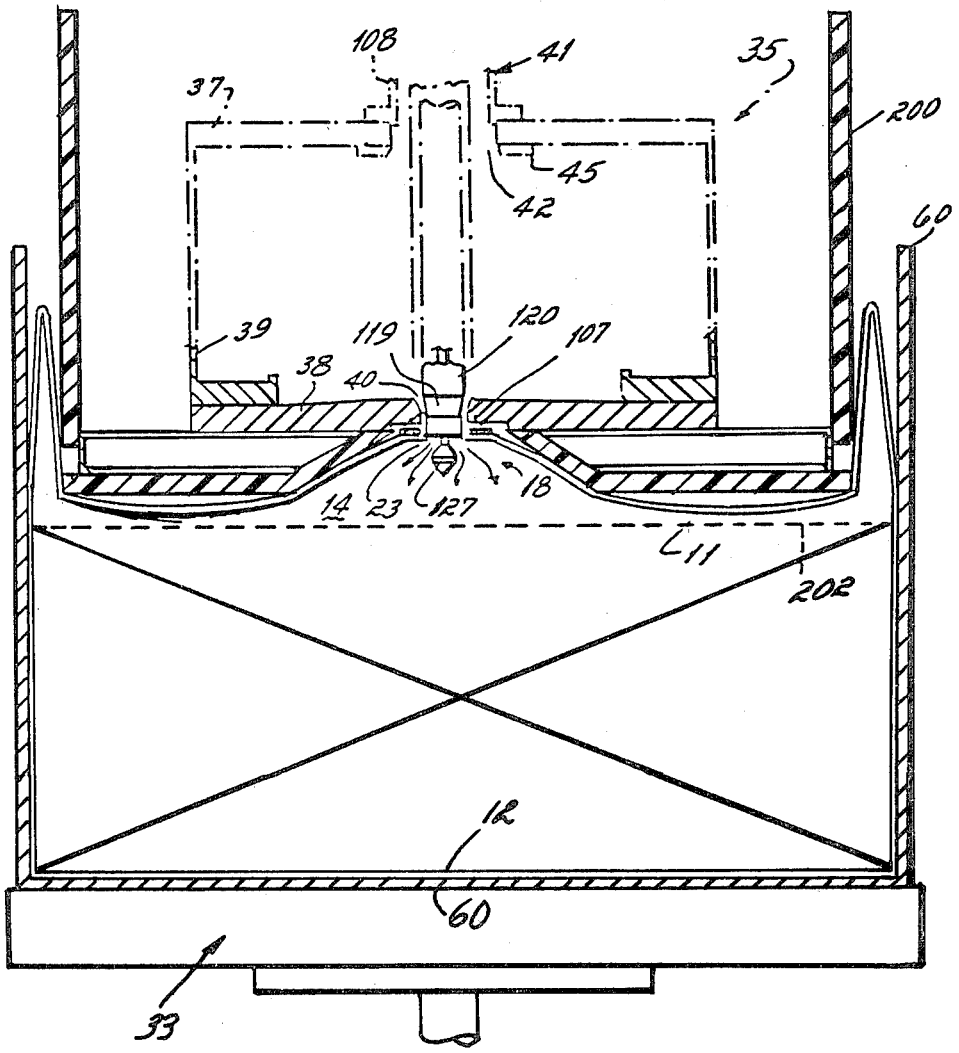
FIG. 11 is a vertical cross-sectional view through the filling chamber and showing a shipping box and container in a partially filled condition.

Fill tube 120 is adapted to be raised to a storage position within its housing as illustrated in FIGS. 3 and 9. In this position, the fill tube below plate 113 is entirely disposed within guide tube 108 and outer tube 110 and nose 131 is spaced above upper wall 37. The fill tube can also be shifted to its lowermost, or filling, position as illustrated in FIG. 11. In this position, the tapered section 119 engages and seals against the bevelled shoulder 29 (FIG. 14) of a bag fitment 18, thereby preventing any food product from contaminating top rim 26 of the fitment. When the fill tube is in its filling position, nose 131 is brought into contact with the frangible membrane 25 and is effective to rupture that membrane to provide access to the interior of the bag 10 causing the segments 25*a* of the ruptured membrane to depend into the interior of the neck in the manner indicated in FIG. 12. When shaft 126 is lowered, for example, by 1½", valve 127 opens so that food product is free to flow downwardly through fill tube 120 and around the valve member into the bag 10 as illustrated in FIG. 11.

After the bag has been filled, actuator rod 126 is raised to elevate valve member 127 into its closed position in contact with seat 130. The fill tube can then be raised by means of cylinders 116 until it is totally withdrawn from the filling chamber into the fill tube housing as shown in FIG. 9. At that time, the fill tube and the fill tube housing, i.e., the interior of tubes 108 and 110, can be sealed from the filling chamber by closure member 43 which is shifted to its closed position, closing opening 42 by actuator 44.

Preferably at this point in the cycle, the exterior surface of the fill tube 120 is rinsed by flowing condensed steam or other sterilizing agents over it. This condensate is introduced around the tube through cross-plate 113 through a suitable inlet connection (not shown), and via the annulus between fill tube 120 and intermediate tube 132. A suitable drain tube (not shown) for this condensate is connected to the interior of the guide tube 108 either through closure member 43 or the base of tube 108.

The details of actuator 44 are shown in FIGS. 3 and 7. As there shown, actuator 44 includes a support base 133 which is bolted or otherwise secured to the top wall 37 of the fill chamber over an opening 134 formed in that wall. The base is sealed to the top wall by means of suitable sealing rings (not shown). Base 133 carries a cylinder mounting bracket 135 which supports a vertical cylinder 136. Cylinder 136 has associated therewith a piston rod 137 which extends downwardly and carries a flange 138 on its lower end in engagement with a thrust bearing 140. Thrust bearing 140 is carried at the upper end of a shaft 141 which is journaled for rotating and reciprocating movement in a suitable journal bearing carried by base 133. Suitable sealing rings (now shown) are interposed between shaft 141 and base 133 to provide a fluid-tight seal.

Base 133 also carries an upstanding cylinder 142 having a cam track 144 machined therein. Cam track 144 receives a follower 145 which extends outwardly from shaft 141. The configuration of the cam track 144 is such that when shaft 141 is lowered a sufficient distance, such that disc 43 clears seat 45, shaft 141 is rotated counterclockwise in FIG. 4 to swing the closure member to its storage position 46.

As shown in FIG. 3, closure member 43 is mounted upon a radial arm 146 carried by the lower end of shaft 141. The closure member is of circular outline configuration and is provided with a frustoconical sealing surface 147 adapted to seat against the mating face of seating ring 45. The seating ring 45 is machined and fitted to a drain line (not shown) which accepts the condensate which is used to wash the fill tube.

In addition to the elements previously described, upper wall 37 of the filling chamber also supports a mounting bracket 148 of actuator assembly 47 for the lid positioning and sealing mechanism 48. Bracket 148 is mounted above an opening 150 in the upper wall and includes a flange 151 which surrounds the opening. Suitable sealing rings (not shown), carried by the flange provide a fluid-tight seal between the flange and upper wall 37 surrounding the opening. Bracket 148 includes a journal section 152 which journals shaft 153 for rotary and vertically reciprocating movements. Suitable sealing rings (not shown) are interposed between the journal section and shaft to provide a fluid-tight seal. The upper end of shaft 153 is joined through a coupling member 154 and thrust bearing 155 to the piston rod of hydraulic cylinder 157.

Shaft 153 contains an axial bore 158. At the upper end of this shaft, the bore connects to a radial port which receives vacuum tube 160 connected to a suitable vacuum pump. The lower end of shaft 153 contains a transverse port which is connected to a vacuum connector line 161 which serves to interconnect bore 158 with vacuum head 50. Vacuum head 50 is carried by a horizontal support arm 162 extending horizontally from the lower end of shaft 153. Cylinder 157 is effective to raise and lower shaft 153, arm 162 and vacuum head 50.

A collar member 163 (FIG. 8) is secured about the periphery of shaft 153. This collar member carries a vertical shaft 164 which is received within an opening in connector 165 carried by the free end of piston rod 166 associated with hydraulic cylinder 167. Cylinder 167 is pivotally mounted between the horizontal arms of angle brackets 168 carried by support bracket 148. Cylinder 167 carries vertical pins which are rotatably journaled in bearings carried by the bracket arms. Cylinder 167 is thus effective to cause rotation of shaft 153 and support arm 162 to shift vacuum head 50 from a position in which it is aligned with opening 40 in platen 38 to a storage position in which it is remote from that opening as illustrated at 52 in FIG. 4.

Figure 12:
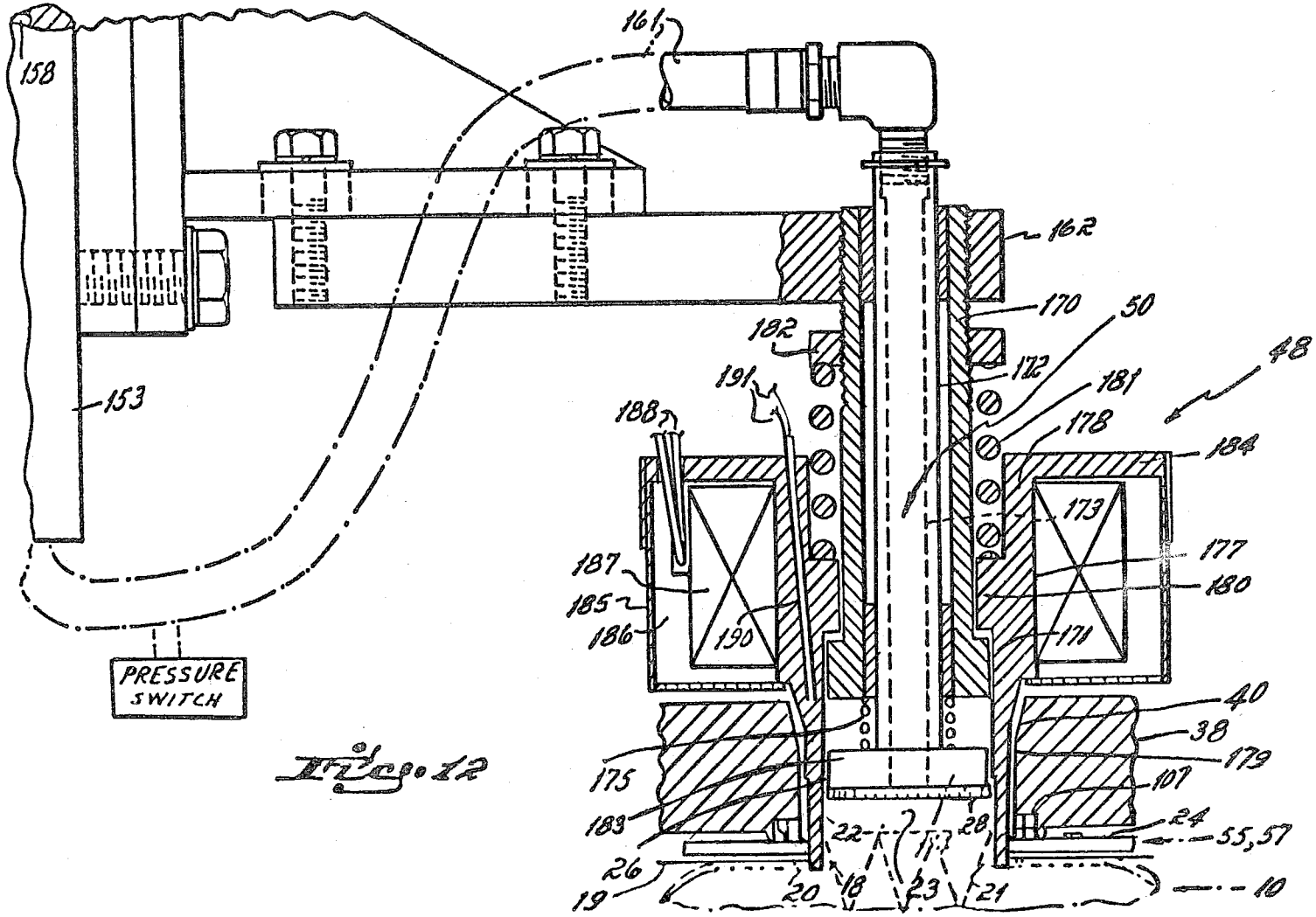
FIG. 12 is a cross-sectional view through the heat sealing unit showing the unit sealing a lid onto the fitment of a container of the present invention.

The details of heat sealing unit 48 and vacuum head 50 are best shown in FIG. 12. As there shown, the vacuum head comprises a vertical support tube 170 which is threadably connected at its upper end to support arm 162. The lower end of tube 170 includes a horizontal flange 171 of a slightly smaller diameter than the inner diameter of neck 22 of fitment 18. Support tube 170 carries a vacuum tube 172 which includes a vertical bore 173. Bore 173 extends throughout the length of tube 172. A flange 174 is formed on the end of tube 172, the flange being of substantially the same diameter as flange 171. A light compression spring 175 is compressed between flanges 171 and 174.

Vacuum head assembly 50 also carries heat sealing unit 48. This unit includes a heat seal platen member 177. Platen 177 includes a tubular section 178 which surrounds support tube 170. Tubular section 178 is provided with an inwardly extending flange 180 adapted to abut lower flange 171.

A heavy spring 181 surrounds support tube 170 and is compressed between flange 180 and an adjustment nut 182. As a result of this construction, platen 177 is spring urged downwardly relative to support arm 162, but is free to move upwardly relative thereto against the force of spring 181. Platen member 177 is further configured to form a depending skirt 179 which terminates in a horizontal annular heat sealing surface 183. This surface has an outer diameter larger than the outer diameter of neck 22 of fitment 18 and an inner diameter smaller than the inner diameter of the fitment so that the heat sealing surface 183 is adapted to completely overlie top rim 26 of fitment 18 as shown in FIG. 12.

Heat sealing platen member 177 includes an outwardly extending top wall 184 which supports a cover member 185 having a peripheral wall and a bottom wall adapted to form with the platen member an annular chamber 186. Chamber 186 receives a suitable heating element 187, such as a Chromalox band heater rated at 125 volts and 675 watts. This heating element is adapted to be connected through leads 188 to a suitable power supply. The platen further has embedded therein a suitable temperature probe 190, such as a Fenwall Thermistor Probe, Style C, with a range of from 200° F.–600° F. This probe is connected through leads 191 to a suitable control for controlling the energization of heater unit 187 to maintain a desired temperature of the heat sealing platen.

Vacuum head 50 is initially spaced above and away from alignment with opening 40. After a bag fitment 18 has been locked in position in opening 40, cylinders 157 and 167 are effective to rotate and lower the vacuum head to bring flange 174 into contact with a foil disc, or lid, 28 which is resting on top of rim 26 of the fitment. It should be noted that flange 174 extends an appreciable distance below sealing surface 183 of the platen so that the foil disc or lid 28 remains spaced from this surface. When the foil disc has been captured by the vacuum applied through bore 173, a drop in pressure is sensed by a pressure switch shown diagramatically in FIG. 12. This switch is responsive to the pressure in vacuum tube 161. Only if the switch is actuated to confirm that a disc has been picked up, cylinders 157 and 167 elevate arm 162 and vacuum head 50 and return it to its storage position spaced from opening 40 (indicated at 52 in FIG. 4). Thereafter, after the bag 10 has been filled and the filling tube withdrawn, cylinders 157 and 167 again rotate arm 162 and the vacuum head into alignment with opening 40. Foil lid 28 is returned to a position in which it covers the neck 22 of fitment 18. Further downward movement of arm 62 causes platen 177 to compress lid 28 against the relatively wide upper rim 26 of fitment 18. The force of this compression is controlled by spring 181. The heated platen is maintained in contact with lid 28 a sufficient time to effect a heat seal between the lid 28 and fitment 18. Thereafter, the vacuum is removed from bore 152 by actuating a suitable valve in the vacuum line and cylinders 157 and 167 coact to raise head 50 and rotate it to its storage position prior to the commencement of the next cycle.

When filling bags of the present invention in accordance with the disclosed filling apparatus and method, bags 10 are supplied with their frangible membranes intact. The bags and associated membrane fitments are presterilized in any suitable manner, for example, by subjecting them to gamma radiation. A presterilized bag of the present invention is draped over a box 60 and the box is placed on the feed roller conveyor section 32. The box is then moved to the fill station by shifting it onto the lift table 33. A lid 28 is placed on fitment 18 and the fitment is placed in the clamping jaw 55 with the jaw being inserted between the flanges 24 and 20 of the fitment 18. The jaw 55 is then pivoted by means of cylinder 88 until fitment 18 is in alignment with opening 40 in the platen. Arm 92 and jaw 55 are then raised by cylinder 79 to bring the fitment into position within opening 40 as shown in FIG. 5A.

With the fitment 18 located within opening 40, secondary jaw 57 is advanced by cylinder 74 until the bevelled surfaces of jaws 57 and 55 are in engagement with one another as shown in FIG. 5B. As a result of the interengagement of these bevelled surfaces, jaw 55 is forced upwardly to compress flange 24 against platen 28 and seal ring 107 with an appreciable force, for example, 600 pounds. As a result, opening 40 is completely sealed by the fitment 18.

During this operation, fitment 18 carries foil lid 28 which rests upon rim 26 as shown in FIG. 5B. The depressed center section of the lid helps to keep the otherwise loose lid in place. During the initial portion of the operating cycle, fill tube 120 is in its elevated, retracted position within the fill tube housing formed by guide tube 108 and outer tube 110. Opening 42 of the fill tube housing is sealed off by member 43 which is seated against seat 45 as shown in FIG. 3. Also during the initial portion of the cycle, vacuum head 50 is in its elevated position remote from the axis of opening 40 as indicated at 52 in FIG. 4.

In the next step, vacuum head 50 is rotated by cylinder 167 and lowered by cylinder 157 to bring flange 174 and vacuum line 172 into engagement with foil lid 28. The valve in the vacuum line is opened so that the foil disc 28 is held against flange 174. Next, the vacuum head 50 is elevated by cylinder 157 and rotated by cylinder 167 to shift it and the foil lid 28 which it is carrying to storage position 52.

At this point, steam or other suitable sterilant is introduced into filling chamber 35 through a suitable inlet fitting 159 (FIG. 3) which can be closed when desired by means of a valve (not shown). This steam is effective to sterilize the foil disc 28, the exposed surface of fitment membrane 25 and the exposed portions of fitment 18, as well as fill chamber 35. It will be recalled that the material for fitment 18 was specifically selected to withstand such heat sterilization. At the completion of the steam sterilization cycle, the steam pressure is decreased from approximately 15–30 psi to a 0.5 psi. Alternately, nitrogen is introduced within the fill chamber to maintain this pressure.

In the next step, closure member 43 is lowered and rotated free from opening 42 by means of hydraulic cylinder 136. Fill tube 120 is then lowered by means of cylinders 116 until nose 131 punctures frangible membrane 25 and the tapered section 119 of the fill tube seats against, and forms a liquid-tight seal with, neck portion 22 and sealing shoulder 29 of fitment 18. This seal between section 119 and the bevelled shoulder 29 prevents any food product from contacting rim 26 of the fitment so as to thereby keep fitment rim 26 clean and receptive to a good heat seal with lid 28 as discussed hereinafter.

It will be recalled that the container carries a heat shield 19, adjacently beneath the fitment and overcovering the surrounding wall portions. Shield 19 also operatively insulated the bag walls and its seal with the fitment during the food filling operation, when handling hot product.

Lift table 33 had previously been raised to elevate box 60. Fill valve 127 is opened by lowering the valve to the position shown in FIG. 11 by means of hydraulic cylinder 125 and product is pumped through the flexible product line 122 and the fill tube into bag 10. As is known in the art, a suitable pressure sensor (not shown) senses the pressure applied by the top of bag 10 against the filled platen. When this pressure reaches a set point, the lift table is automatically lowered until the pressure is released. The downward movement of the lift table is then stopped until pressure again builds up to a set point. In this manner, as the bag 10 is progressively filled, the lift table and box 60 are lowered in a step-by-step manner until the bag is completely filled, at which time the lift table is lowered into alignment with the feed conveyor section 32 and discharge conveyor section 34. This step-by-step lowering of the lift table in response to pressure build-up within bag 10 is well known and constitutes no portion of the present invention.

When the bag is filled, a suitable valve (not shown) shuts off flow of the product to the fill tube. The fill tube valve 127 is elevated by means of cylinder 125 to close the fill tube. The fill tube is then raised within its housing by means of cylinders 116. Closure member 43 is rotated and brought into engagement with seat 45 to seal the fill tube housing and the exterior of the fill tube is rinsed with steam condensate which is introduced through the annulus between the fill tube 120 and the intermediate tube 132. Steam or nitrogen is then introduced into housing 41 to establish a pressure of approximately 3 psi.

In the next step, vacuum head 50 is again rotated into alignment with fitment 18 and is lowered to place lid 28 on rim 26. It will be understood that during the storage of lid 28 and its transport away from and toward the fitment 18, the lid is held spaced from heat sealing platen 177 due to the fact that flange 174 is positioned a sufficient distance below surface 183 to provide a space between that surface and the lid. However, during the sealing operation, arm 162 moves downwardly a sufficient distance so that spring 181 forces the heat sealing platen into contact with the peripheral portion of lid 28 overlying rim 26 to effectively heat seal the lid to the rim.

After the lid 28 has been heat sealed to rim 26, the vacuum head 50 is raised and pivoted to return it to its storage position 52. The filling chamber 35 is then vented to atmosphere through a suitable valve in the steam line (not shown). Secondary jaw 57 is retracted by cylinder 74 to unclamp fitment 18. Jaw 55 is retracted to release the fitment and is returned to its storage position remote from opening 40 after the bag and box have been lowered beyond interference with the swing arm 92. A shipping cap 27 is threaded over neck 22 to protect lid 28 and filled container 10 and its box 60 are then shifted onto the discharge conveyor section 34. A suitable cover is preferably applied to box 60 to ready the box for shipment.

It will be recognized that due to the selection and combination of materials for the container walls and membrane fitment and their cooperative relation to an asceptic filling apparatus, the container 10 of the invention is uniquely adapted to gamma radiation and heat sterilization without embrittlement or loss of strength, and that the sealing connection of the fitment with the filling chamber and fill tube permits sterilization of the fitment and connection of the hermetic seal within the filling chamber, all so as to carry out the objective of providing a presterilzed container, receptive of sterilized food product and capable of resealing in a sterilized condition for prolonged storage lift.

From the above disclosure of the general principles of the present invention and the preceding description of a preferred embodiment, those skilled in the art will readily comprehend various modifications to which the invention is susceptible. Thus, it is contemplated that pre-sterilized flexible containers having wall constructions differing from the specific wall construction presently disclosed can be used with the present membrane fitment as part of the disclosed asceptic filling system. It is further contemplated that the disclosed filling apparatus can be employed to fill asceptic plastic drums or other asceptic rigid containers constructed to include a membrane fitment as disclosed herein. Accordingly, this invention is to be limited only by the scope of the following claims:

The embodiments of the present invention in which an exclusive property or privilege is claimed are defined as follows:

1. For use with an asceptic filling apparatus having a filling chamber adapted to be sterilized and provided with an opening for the passage of asceptic filling means, an asceptic container for the storage of flowable food product comprising: gas impermeable walls, a rigid fitment member sealed to one of said walls and detachably receptive in the opening of the filling chamber to effect sealed connection therebetween; a rupturable membrane closing said fitment member and located axially inwardly of the outer end thereof, and seal means to effect sealed connection with the filling means during the filling of said container, said membrane being rupturable by the filling means for the introduction of flowable food product to the container's interior, and said fitment member being capable of gamma ray sterilization without substantial embrittlement or loss of strength.

2. The invention of claim 1 wherein said walls are capable of withstanding gamma ray sterilization without loss of strength.

3. The invention of claim 1 wherein said asceptic container is a pre-sterilized flexible pouch having walls comprising multiple layers of flexible plastic materials productive of a gas impermeable barrier and joined to effect a sealed interior chamber receptive of food product.

4. The invention of claim 1, and lid means adapted to be sterilized and sealed over the outer end of said fitment member within the filling chamber prior to detaching said fitment member from the filling chamber.

5. The invention of claim 1 wherein said fitment member is made of high density polyethylene.

6. The invention of claim 1 wherein said fitment member comprises a rigid, open top cylindrical neck, an external first flange extending radially outwardly of said neck to effect said sealed connection with the filling chamber, and a second external flange extending radially outwardly of the lower end of said neck to provide sealed connection with said one wall of said container.

7. The invention of claim 1 wherein said fitment member comprises a rigid, open top cylindrical neck, a chamfered and radially inwardly projecting portion formed axially inwardly of the open top of said neck and forming said seal means, said rupturable membrane being joined to said chamfered portion and extending across said neck, an external first flange extending radially outwardly of said neck to effect said sealed connection with the filling chamber, and a second external flange extending radially outwardly of the lower end of said neck to provide sealed connection with said one wall of said container.

8. The combination of claim 7 wherein said membrane is formed integrally with said neck and chamfered portion.

9. The combination of claim 7 wherein said membrane comprises a polyethylene foil disc member heat sealed to the underside of said chamfered portion.

10. The invention of claim 8 wherein said integral membrane is provided with plural radially extending indentations to effect its rupture into arcuate segments.

11. The invention of claim 1, and a heat shield attached in surrounding relation to said fitment member and protectively insulating and overlying adjacent wall portions of said container and the sealed junction thereof with said fitment member from temperatures generated within the filling chamber.

12. The invention of claim 1 wherein said walls are constructed of three separate, superposed plies, the outermost ply forming a multilayer, high oxygen permeation resistant barrier consisting of an outer layer of Nylon; a second layer of ethyl vinyl alcohol film; a third layer of Nylon; a fourth tie layer of linear, low density polyethylene; a fifth layer of linear low density polyethylene film; a sixth tie layer, and a seventh layer of linear low density polyethylene film; said tie layers operatively interjoining the layers contactingly adjacent thereto; and intermediate and innermost plies constituting linear low density polyethylene films.

13. The invention of claim 1 wherein said walls are constructed of three separate superposed plies; the outermost ply being a five layer gas and light resistant barrier consisting of a first layer of Nylon film, a second tie layer of linear low density polyethylene, a third layer of metal foil aluminum, a fourth tie layer of linear low density polyethylene, and a fifth layer of linear low density polyethylene film; and second and third plies of linear low density polyethylene film.

14. In an internally asceptic container attachable to an asceptic filling chamber of filling apparatus having asceptic fill tube means for introducing flowable product to the interior of the container, a fitment member adapted for sealed connection with the filling chamber, comprising: a rigid, open top neck, a chamfered inwardly projecting seal portion formed axially inwardly of the open top of said neck for sealed connection with the asceptic fill tube means, asceptic rupturable membrane means joined to said chamfered portion and extending across said neck to block the interior thereof, said membrane being ruptured by the passage of the fill tube means therethrough; an external first flange extending radially outwardly of said neck and operable to effect sealed connection with the asceptic filling chamber, and a second external flange extending radially outwardly of the lower end of said neck and operable to effect sealed connection with one wall of the container.

15. A new article of manufacture comprising: a bag having two opposed walls of flexible, gas impermeable, material said walls being joined about their peripheries to form a sealed interior chamber for the bag; and a rigid fitment member sealed to one of said walls in communication with said chamber; said fitment member having a rigid, open top neck; said neck having an exposed outer rim, adapted to receive a lid in heat sealed relationship therewith, and an inner end; a rupturable membrane closing off the interior of said neck; a first external clamping flange extending about an intermediate portion of said neck, and a second external flange extending outwardly of said inner end of said neck.

16. The bag of claim 15 in which said rupturable membrane is spaced inwardly of said exposed outer rim.

17. The bag of claim 15 further comprising means adjacent the periphery of said membrane for effecting sealed connection with a member insertable in said neck and operable to introduce materials into said chamber after rupturing said membrane.

18. The bag of claim 15 wherein said walls and fitment member are capable of withstanding gamma ray sterilization without substantial loss of strength.

* * * * *

US004445550B1

REEXAMINATION CERTIFICATE (3748th)

United States Patent [19] [11] B1 4,445,550

Davis et al. [45] Certificate Issued Mar. 9, 1999

[54] FLEXIBLE WALLED CONTAINER HAVING MEMBRANE FITMENT FOR USE WITH ASEPTIC FILLING APPARATUS

[75] Inventors: John C. Davis, Palatine; Ronald J. Reiss, Hoffman Estates, both of Ill.; Albert F. Rica, Stockton, Calif.

[73] Assignee: Scholle Corporation, Irvine, Calif.

Reexamination Request:
No. 90/004,479, Dec. 10, 1996

Reexamination Certificate for:

| | |
|---|---|
| Patent No.: | **4,445,550** |
| Issued: | **May 1, 1984** |
| Appl. No.: | **409,903** |
| Filed: | **Aug. 20, 1982** |

[51] Int. Cl.[6] ..... B65D 41/50

[52] U.S. Cl. ..... 141/329; 141/330; 53/469; 206/524.2; 206/525; 220/410; 220/465; 222/105; 222/107; 428/35

[58] Field of Search ..... 141/10, 14, 313, 141/319, 329, 330, 325, 326, 327, 339; 53/133.2, 284.7, 469; 220/410, 461, 465; 222/105, 107; 428/35.9; 137/68.19, 68.27; 206/525, 524.1

[56] References Cited

U.S. PATENT DOCUMENTS

| | | | |
|---|---|---|---|
| 2,930,170 | 3/1960 | Holsman et al. | 53/37 |
| 3,340,671 | 9/1967 | Loo | 53/37 |
| 3,635,234 | 1/1972 | Dawson | 137/68 |
| 3,653,546 | 4/1972 | Hazard | 222/83 |
| 4,137,930 | 2/1979 | Scholle | 137/68 |
| 4,201,208 | 5/1980 | Cambio, Jr. | 128/214.2 |
| 4,309,446 | 1/1982 | Stillman | 428/35 |
| 4,421,146 | 12/1983 | Bond et al. | 141/349 |

FOREIGN PATENT DOCUMENTS 1535335 12/1978 United Kingdom .

OTHER PUBLICATIONS

Food Manufacture, Equipment, p. 12, Nov. 1978.

*Primary Examiner*—Henry J. Recla

[57] ABSTRACT

There is disclosed an aseptic flexible walled container having a rigid fitment member cooperative with an aseptic filling apparatus and including a neck, outer flanges surrounding the neck, a frangible membrane and an outer end rim receptive of an hermetically sealed lid. The neck is formed with an internal chamferred seating shoulder for fluid-tight engagement with a fill tube. One outer flange cooperates with clamping jaws of the asep- tic filling apparatus for detachably sealing the fitment to a sterilizing chamber and placing it in position for inser- tion of the filling tube which ruptures the membrane and permits the aseptic introduction of product to the container's interior. The other outer flanges is secured to an opening in a wall of the flexible container. The joined fitment and container are presterilized prior to filling. Selected materials for the multi-ply container walls and the fitment permit the container to withstand gamma ray and other sterilization treatment, heat and pressure while maintaining required strength. After the container is aseptically filled, such as with flowable food product, the fill tube is withdrawn and a lid is hermeti- cally sealed onto the rim of the fitment. A heat shield adjacent a container wall surrounds the fitment to pro- tect the container from excessive heat generated by the associated filling apparatus during filling.

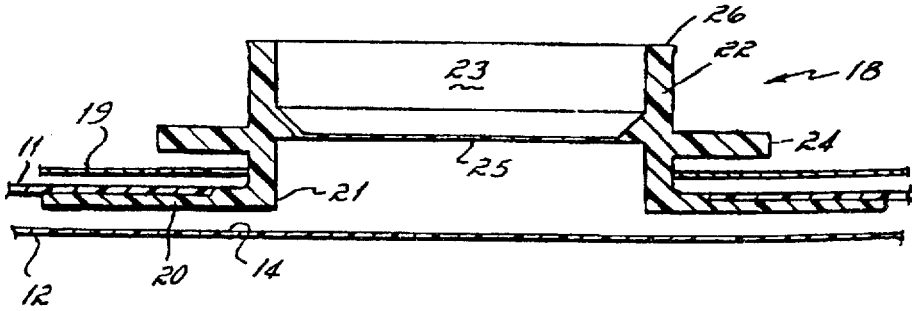

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *